US005325679A

United States Patent [19]

Tatematsu et al.

[11] Patent Number: 5,325,679

[45] Date of Patent: Jul. 5, 1994

[54] ELECTRIC CONTROL APPARATUS FOR AUGER TYPE ICE MAKING MACHINE

[75] Inventors: Susumu Tatematsu; Junichi Hida; Yasumitsu Tsukiyama; Naoya Uchida, all of Toyoake, Japan

[73] Assignee: Hoshizaki Denki Kabushiki Kaisha, Toyoake, Japan

[21] Appl. No.: 859,456

[22] PCT Filed: Oct. 25, 1991

[86] PCT No.: PCT/JP91/01464

§ 371 Date: Nov. 23, 1992

§ 102(e) Date: Nov. 23, 1992

[30] Foreign Application Priority Data

Oct. 26, 1990 [JP] Japan ..... 2-289508
Oct. 26, 1990 [JP] Japan ..... 2-289509

[51] Int. Cl.[5] ..... F25C 1/14
[52] U.S. Cl. ..... 62/188; 62/233
[58] Field of Search ..... 62/188, 233, 354

[56] References Cited

U.S. PATENT DOCUMENTS 3,740,963 6/1973 Lyman et al.' ..... 62/188 X
4,644,757 2/1987 Hida et al. ..... 62/188
4,982,573 1/1991 Tatematsu et al. ..... 62/188 X

FOREIGN PATENT DOCUMENTS 61-39590 9/1986 Japan .
61-240067 10/1986 Japan .
63-10453 3/1988 Japan .

*Primary Examiner*—William E. Tapolcai
*Attorney, Agent, or Firm*—Nikaido, Marmelstein, Murray & Oram

[57] ABSTRACT

When an upper limit float switch Fu is closed after a lower limit float switch Fl is closed according to a rise of the level of water in a water tank 60, a solenoid water valve WV is closed and power supply to an electric motor for driving an auger 40 and a compressor connected to an evaporator 30 is then allowed. When the lower limit float switch Fl is opened, the solenoid water valve WV is opened and power supply to the electric motor and compressor is cut off. When the lower limit float switch Fl is opened, a time set longer by a predetermined time than the time for the water level in the water tank 60 to reach the upper limit from the lower limit is measured. When the lower limit float switch Fl is kept open due to suspension of water supply, the solenoid water valve WV is closed in response to the completion of measurement of the time. This can suppress power consumption of the solenoid water valve WV.

5 Claims, 9 Drawing Sheets

ELECTRIC CONTROL APPARATUS FOR AUGER TYPE ICE MAKING MACHINE

TECHNICAL FIELD

The present invention relates to an auger type ice making machine, and, more particularly, to an electric control apparatus which automatically controls water supply to an evaporator housing of the auger type ice making machine and the ice making operation of this ice making machine in accordance with the level of water in a water tank connected to the evaporator housing.

BACKGROUND ART

Conventionally, in an auger type ice making machine, as disclosed in, for example, Japanese Utility Model Publication No. 63-10453, a pair of normally open type float switches are provided at the top and bottom of a water tank, so that when the lower float switch is opened, water to be formed into ice is supplied into the water tank from a water source by opening of a solenoid water valve, an ice making operation starts when both float switches are closed in accordance with an increase of water in the water tank to a given quantity to form the water from the water tank into ice crystals and move the ice crystals out of an evaporator housing with an auger to sequentially store them as pieces of hard ice in a storage bin, the same water supply to the water tank and the ice making operation are repeated after the lower float switch is opened in accordance with a decrease of water in the water tank.

With the above structure, as long as both float switches properly function, the ice making operation is automatically ensured when suspension of water supply occurs and water supply is then recovered. When suspension of water supply occurs, however, the lower float switch is opened, holding the solenoid water valve open. For this reason, the longer the suspension of water supply continues, the greater the wasteful power consumption becomes to keep the solenoid water valve open.

Meanwhile, there may be such malfunctions that the individual float switches are disabled to be opened or closed due to dust entering together with water in the water tank or melting of the contacts of each float switch caused by an excessive current flowing therethrough. In those malfunctions, if closing of the upper float switch is not possible, this upper float switch cannot be closed when water in the water tank increases to a given quantity. The solenoid water valve cannot therefore be closed, so that supply of water in the water tank from the water source will continue even after the water tank is filled with water. As a result, water in the water tank is discharged wastefully through an overflow pipe and the place where the ice making machine is set is flooded with water.

If opening of the upper float switch is not possible, this upper float switch cannot be opened even when water in the water tank is insufficient. The solenoid water valve cannot therefore be opened, so that ice making operation will continue even when there is insufficient water in the water tank or insufficient water in the evaporator housing, resulting in over freezing in the evaporator housing. As a result, the amount of circulation of a fluid refrigerant from the evaporator in the evaporator housing to the compressor increases, damaging the components of the compressor or the over freezing in the evaporator housing acts as an over load to a driving mechanism through the auger, damaging the components of this driving mechanism.

If closing of the lower float switch is disabled, this lower float switch cannot be closed even though the level of water in the water tank is kept proper between the locations of the upper and lower float switches. Consequently, water supply to the water tank from the water source via the solenoid water valve starts even though the proper amount of water is remaining in the water tank. Accordingly, in this case water is not used for ice making to sufficiently reduce the water for one cycle retained in the water tank, dropping the ratio of use of the water and shortening the service life of the solenoid water valve due to the increased frequency of opening/closing actions.

If opening of the lower float switch is disabled, this lower float switch cannot be opened even though there is insufficient water in the water tank. Therefore, ice making operation will continue even when there is insufficient water in the evaporator housing, resulting in over freezing in the evaporator housing. This causes substantially the same shortcoming as arising in the case where opening of the upper float switch is disabled.

Further, with the above-described structure, if a refrigerant leaks from a pipe in a refrigeration circuit having an evaporator or compressor, the evaporator does not show sufficient cooling performance due to an insufficient refrigerant, making the ice making operation unnecessarily longer. In some cases, the refrigeration circuit becomes a vacuum-operating state due to the refrigerant leakage, so that outside air is sucked inside, causing a critical damage on the components of the circuit.

DISCLOSURE OF THE INVENTION

It is therefore a primary object of the present invention to provide an electric control apparatus for an auger type ice making machine which can minimize the power consumption for opening the solenoid water valve upon occurrence of suspension of water supply, and can immediately stop water supply to the water tank or stop an ice making operation when the float switches malfunction or the refrigeration circuit malfunctions due to leakage of the refrigerant.

This object of the present invention is achieved by an auger type ice making machine having a water tank for supplying water connected to an evaporator housing incorporating an auger rotatable by an electric motor and having an evaporator provided on an outer wall thereof, the ice making machine comprising:

a first float switch for detecting the level of water in the water tank and being opened (or closed) when the water level drops to a lower limit;

a second float switch for detecting the level of water in the water tank and being closed (or opened) when the water level reaches an upper limit;

a first control means for, when the first float switch is opened (or closed), energizing a solenoid water valve connected to the water tank and cutting off power supply to the electric motor and a compressor connected to the evaporator;

a second control means for, when the second float switch is closed (or opened) after the first float switch is closed (or opened) in accordance with an increase in the water level, closing the solenoid water valve by deenergization thereof and then permitting power supply to the electric motor and the compressor;

a timer means for functioning when the first float switch is opened (or closed) to start measuring a control time set longer by a predetermined time than a time for the level of water in the water tank to reach the upper limit from the lower limit, and stopping functioning upon elapse of the control time; and a third control means for closing the solenoid water valve by deenergization in response to functional stop of the timer means when the first float switch is kept opened (or closed) due to suspension of water supply.

BRIEF DESCRIPTION OF THE DRAWINGS

One embodiment of the present invention will now be described referring to the accompanying drawings. FIGS. 1 through 4 illustrate the general structure of an auger type ice making machine to which the present invention is applied. This ice making machine comprises a machine assembly B (see FIG. 1), a refrigeration circuit R (see FIG. 2) and a control circuit E (see FIGS. 3 and 4) which controls the driving of the machine assembly B and the refrigeration circuit R.

Figure 1:
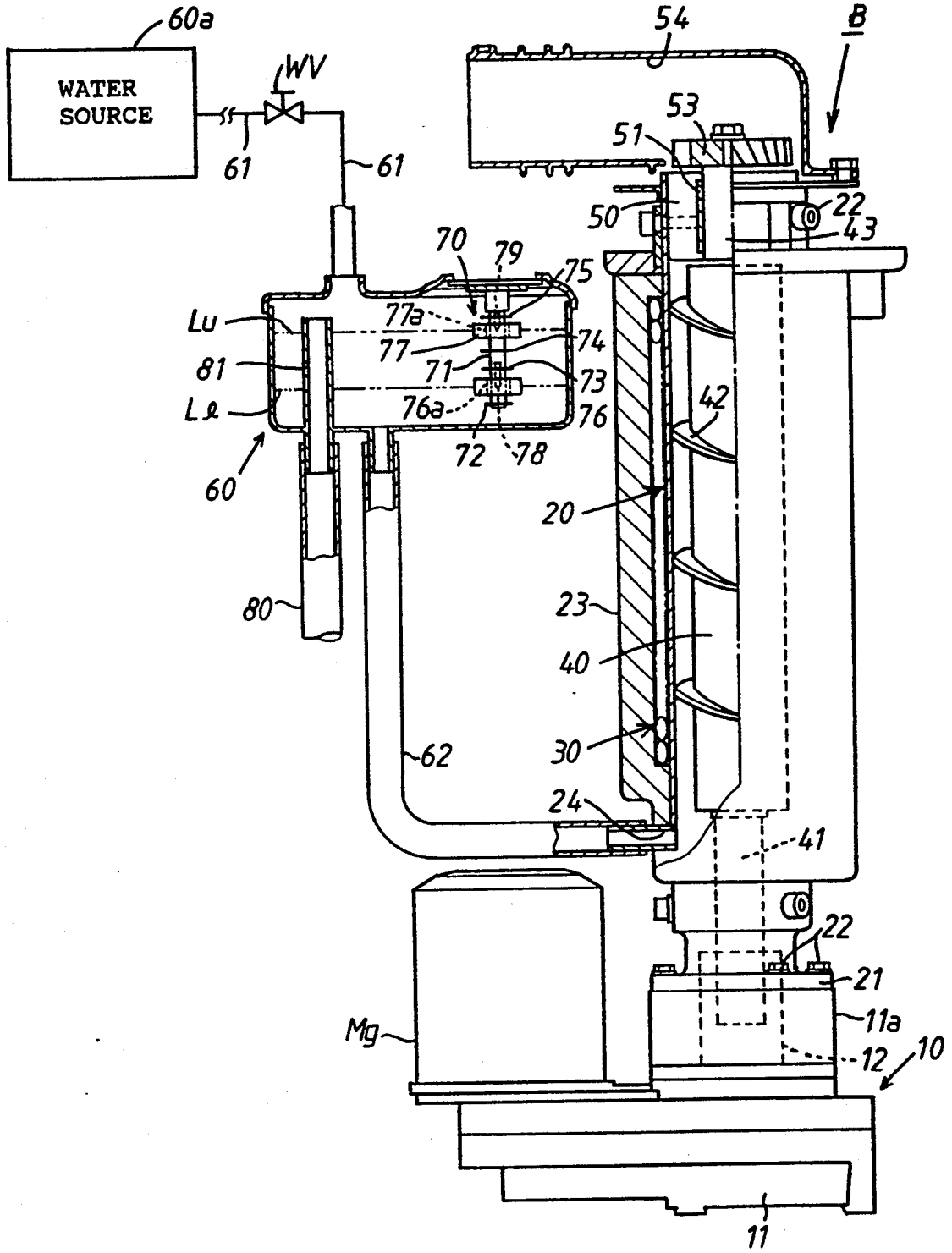
FIG. 1 is a partly cutaway view of an ice making machine assembly according to one embodiment of the present invention.

The machine assembly B has a speed reducer 10 which is driven by a motor Mg. This speed reducer 10 reduces the rotational speed of the motor Mg by means of a reduction gear mechanism in a casing 11 and transmits the speed to an output shaft 12 in a vertical cylindrical portion 11*a* of the casing 11. An evaporator housing 20 has a lower flange portion 21 fastened to the upper end of the vertical cylindrical portion 11*a* by individual screws 22, so that it stands upright on the cylindrical portion 11*a* vertically and coaxially. An evaporator 30 is coaxially wound around the outer surface of the evaporator housing 20. The evaporator 30 cools water entering the evaporator housing 20 to form it into a flake of ice as will be described later, in accordance with a coming refrigerant.

Figure 2:
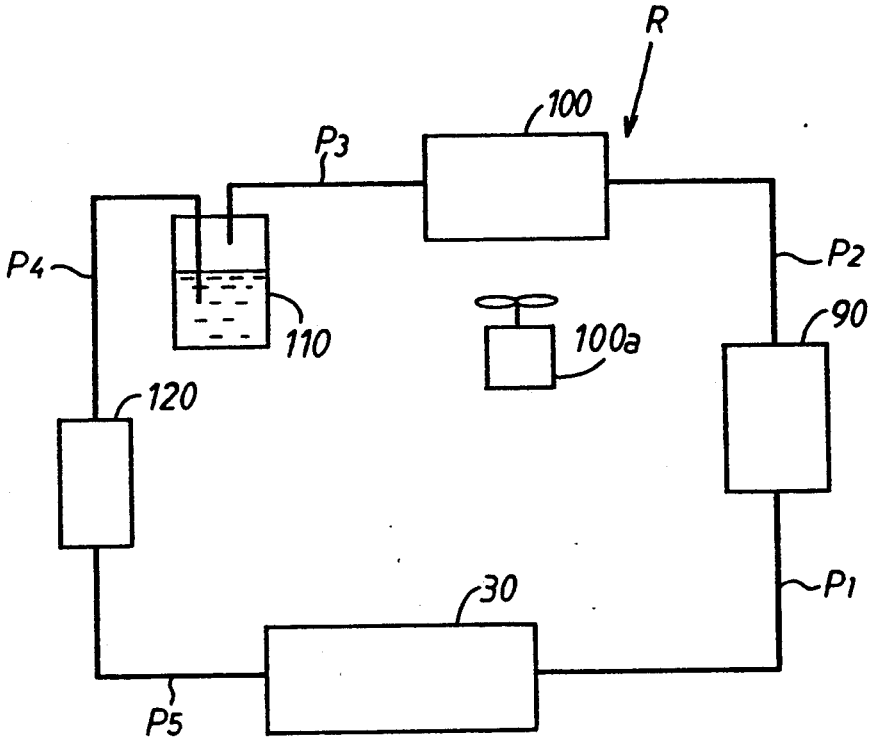
FIG. 2 is a circuit diagram of a refrigeration circuit of the ice making machine.

An auger 40 is fitted coaxially rotatable in the evaporator housing 20, and has its lower-end rotary shaft 41 supported unrotatable relatively to the output shaft 12 in the vertical cylindrical portion of the casing 11. The auger 40 sequentially scrapes ice crystals in the evaporator housing 20 by means of a helical blade 42 and guides them upward in accordance with the rotation of the auger 40. In FIG. 2, the reference numeral 23 denotes an insulation housing.

An extruding head 50 is disposed on the upper-end inner surface of the evaporator housing 20 and a sleeve metal 51 rotatably fitted over an upper-end rotary shaft 43 of the auger 40, and is secured to the top end portion of the evaporator housing 20 by fastening individual screws to support the sleeve metal 51 coaxially. The extruding head 50 compresses ice moved upward by the auger 40 in a rod, yielding a rod of compressed ice. A cutter 53 is fitted coaxially on the upper end portion of the upper-end rotary shaft 43 of the auger 40 to sequentially cut the rod of compressed ice from the extruding head 50 and delivers the pieces of ice through a delivery duct 54 to a storage bin (not shown).

A water tank 60 is supported on the side of the evaporator housing 20 by a proper securing member, as shown in FIG. 1, so that water from a water source 60*a* is supplied into the water tank 60 by selective opening of an water valve WV in the form of a normally closed type solenoid valve, which is disposed in a water supply pipe 61. The water tank 60 is so designed as to permit the retained water to flow via a pipe 62 into the evaporator housing 20 through a lower-end opening 24 thereof. In the water tank 60 a float switch mechanism 70 is suspended from the right portion of the top wall of the water tank 60, with an overflow pipe 80 vertically extending through the left portion of the bottom wall of the water tank 60 at its upper end portion 81.

The float switch mechanism 70 has a hollow rod 71 made of a nonmagnetic material, which is suspended from the right portion of the top wall of the water tank 60. A pair of ring stoppers 72 and 73 and a pair of ring stoppers 74 and 75 are coaxially fitted over the outer surface of the hollow rod 71 at the proper intervals from the lower portion of the rod 71 to the upper portion. A ring float 76 is fitted loosely over the hollow rod 71 between the stoppers 72 and 73 coaxially and movable in the vertical direction. A ring float 77 is fitted loosely over the hollow rod 71 between the stoppers 74 and 75 coaxially and movable in the vertical direction. Ring magnets 76*a* and 77*a* are fitted coaxially in the hollow portions of the floats 76 and 77, respectively. In the hollow portion of the hollow rod 71, normally open type reed switches 78 and 79 are buried in association with the stoppers 73 and 75. The reed switch 78 constitutes a normally open type lower limit float switch Fl together with the float 76, while the reed switch 79 constitutes a normally open type upper limit float switch Fu together with the float 77.

Thus, the reed switch 78 opens responsive to seating of the float 76 on the stopper 72, which means that the lower limit float switch Fl opens. When the level of water in the water tank 50 reaches a lower limit level Ll, the reed switch 78 is closed by the magnet 76*a* of the float 76 floating at the lower limit level Ll. This closes the lower limit float switch Fl. The reed switch 79 opens responsive to seating of the float 77 on the stopper 74, thus opening the upper limit float switch Fu. When the level of water in the water tank 50 reaches an upper limit level Lu, the reed switch 79 is closed by the magnet 77*a* of the float 77 floating at the upper limit level Lu. As water supply to the water tank 60 is completed, the upper limit float switch Fu is closed. The overflow pipe 80 discharges excess water outside when the water level in the water tank 50 exceeds the upper limit level Lu.

Referring now to FIG. 2, the structure of the refrigeration circuit R will be explained. A compressor 90 is driven by a compressor motor Mc (see FIG. 3) to suck a refrigerant from the evaporator 30 through a pipe P1 to compress it, and allows the refrigerant as a compressed refrigerant with high temperature and high pressure to flow into a condenser 100 via a pipe P2. The condenser 100 condenses the coming compressed refrigerant and causes it to pass via a pipe P3 to a receiver 110 in a cooling action of a cooling fan 100*a*. The cooling fan 100*a* is driven by a fan motor Mf (see FIG. 3). The receiver 110 performs gas-liquid separation of the received condensed refrigerant and causes only the liquid component to flow as a circulation refrigerant via a pipe P4 to an expansion valve 120. The expansion valve 120 expands the received refrigerant and permits it to flow into the evaporator 30 via a pipe P5.

The control circuit E is so designed as to be applied with an AC voltage from a commercially available power supply Ps via a circuit breaker ELB between common leads L1 and L2. A timer section Tk constitutes a first timer together with a normally open type timer switch K. The timer section Tk has one end connected to the common lead L1 through parallel-connected normally closed type relay switches S1 and U1, and a normally open type relay switch Q1 connected in series to both relay switches S1 and U1. The timer section Tk has the other end connected to the common lead L2 via a normally open type relay switch V1. Accordingly, when applied with an AC voltage from both common leads L1 and L2 with the individual relay switches Q1, S1, U1 and V1 closed, the timer section Tk functions to measure a predetermined time Dk. The timer switch K opens when measuring the predetermined time Dk by the timer section Tk is completed, and is closed in response to cutoff of the AC voltage from the common leads L1 and L2 to the timer section Tk. The predetermined time Dk is set about 90 sec, longer than the sum of the time to supply water via a water valve WV in the water tank 60 to the upper limit level Lu and the time required to energize a relay coil Ru.

A relay coil Rv constitutes a relay together with the relay switch V1, a normally open type relay switch V2, a normally closed type relay switch V3 and normally open type relay switches V4 and V5. This relay coil Rv has one end connected to the common lead L2 and the other end connected to the common lead L1 via the timer switch K, a normally closed type timer switch M and a parallel circuit of a normally open type self-recovery type operation switch SW and the normally open type relay switch V2 and a normally open type relay switch Y1. The relay coil Rv is energized by temporary closing of the operation switch SW caused by closing of both timer switches K and M to close the individual relay switches V1, V2, V4 and V5 and open the relay switch V3 at the same time, and is self-retained by closing the relay switch V2.

A timer section Tm constitutes a second timer together with the timer switch M. The timer section Tm has one end connected to the common lead L1 through a normally open type relay switch W1, and has the other end connected to the common lead L2. Accordingly, when selectively applied with an AC voltage from both common leads L1 and L2 via the relay switch W1, the timer section Tm functions to measure a predetermined time Dm. The timer switch M opens upon completion of the time measurement by the timer section Tm, and is closed in response to cutoff of the AC voltage from the common leads L1 and L2 to the timer section Tm caused by opening of the relay switch W1. The predetermined time Dm corresponds to the maximum value of the sum of the time (about 1 minute) to activate the compressor 90 after closing of the upper limit float switch Fu, the time (about 3 minutes) to start forming ice crystals after activation of the compressor 90, the time (5 to 15 minutes) for the lower limit float switch Fl to be closed after closing of the upper limit float switch Fu, and a predetermined margin time.

A timer section Tn constitutes a third timer together with a normally open type timer switch N. This timer section Tn has one end connected to the common lead L1 through a parallel circuit of the relay switch V3 and a normally open type relay switch Y2, and has the other end connected to the common lead L2 through a normally open type relay switch Q2. Accordingly, the timer section Tn functions to measure a predetermined time Dna when applied with an AC voltage from both common leads L1 and L2 with either the relay switch V3 or Y2 and the relay switch Q2 closed, and measures a predetermined time Dnb upon completion of the measurement of the predetermined time Dna. The timer switch N is kept open while the timer section Tn measures the predetermined time Dna, and is kept closed while the time section Tn measures the predetermined time Dnb. The timer switch N also opens when the measurement of the predetermined time Dnb is completed. The predetermined time Dna is set to a value between one to three hours, and the predetermined time Dnb is set to a value between 1 to 60 sec.

A relay coil Ry constitutes a relay together with both relay switches Y1 and Y2. This relay coil Ry has one end connected to the common lead L1 via the timer switch N, and has the other end connected to the common lead L2 via the relay switch Q2. The relay coil Ry is energized to close both relay switches Y1 and Y2 when the timer switch N and relay switch Q2 are both closed. A relay coil Rq constitutes a relay together with the individual relay switches Q1, Q2 and Q3. This relay coil Rq has one end connected to the common lead L1 via a normally closed type stored ice detector SI, and has the other end connected to the common lead L2. The relay coil Rq is energized to close the individual relay switches Q1, Q2 and Q3 when the stored ice detector SI is closed. When the quantity of stored ice in the aforementioned storage bin reaches a predetermined full quantity, the stored ice detector SI detects it and opens.

A relay coil Rw constitutes a relay together with a relay switch W1, a normally open type relay switch W2, a normally closed type relay switch W3 and a normally open type relay switch W4. This relay coil Rw has one end connected to the common lead L1 via the upper limit float switch Fu and the stored ice detector SI. The one end of the relay coil Rw is further connected to the common lead L1 via the lower limit float switch Fl, the relay switch W2 and the stored ice detector SI. The relay coil Rw has the other end connected to the common lead L2. The relay coil Rw is energized to close the individual relay switches W1, W2 and W4 and open the relay switch W3 when the upper limit float switch Fu is closed with the stored ice detector SI closed. The relay coil Rw self holds the energization when the lower float switch Fl is closed caused by the closing of the relay switch W2. The relay switch W3 has one end connected to the common lead L1 via the stored ice detector SI, and has the other end connected to the common lead L2 via the water valve WV and both relay switches Q3 and V4. The relay switch W3, when closed, permits application of an AC voltage to the water valve WV from the common leads L1 and L2 in order to open the water valve WV while the stored ice detector SI and both relay switches Q3 and V4 are closed. The water valve WV is closed when the stored ice detector SI and any of the relay switches W3, Q3 and V4 open.

Figure 3:
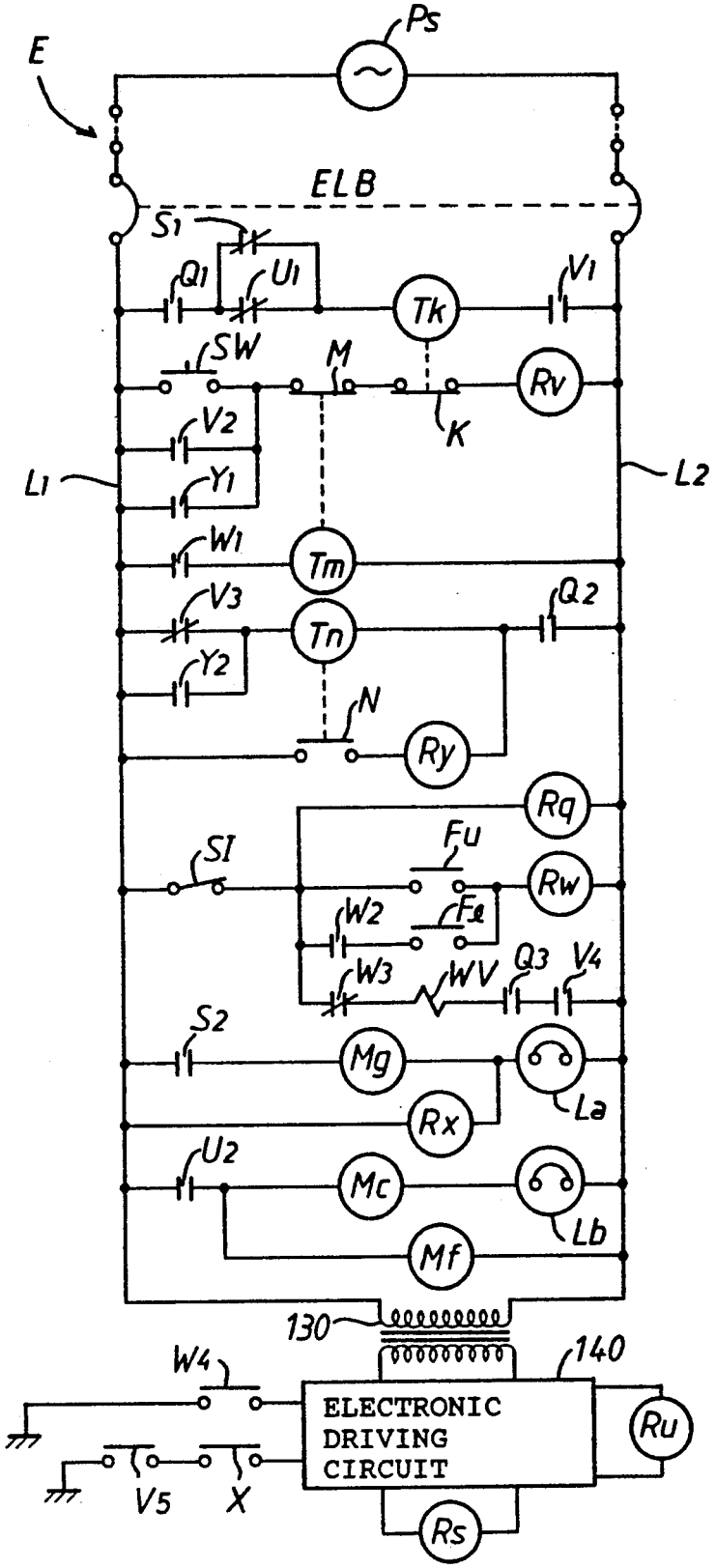
FIG. 3 is an electric control circuit diagram of the ice making machine.
Figure 4:
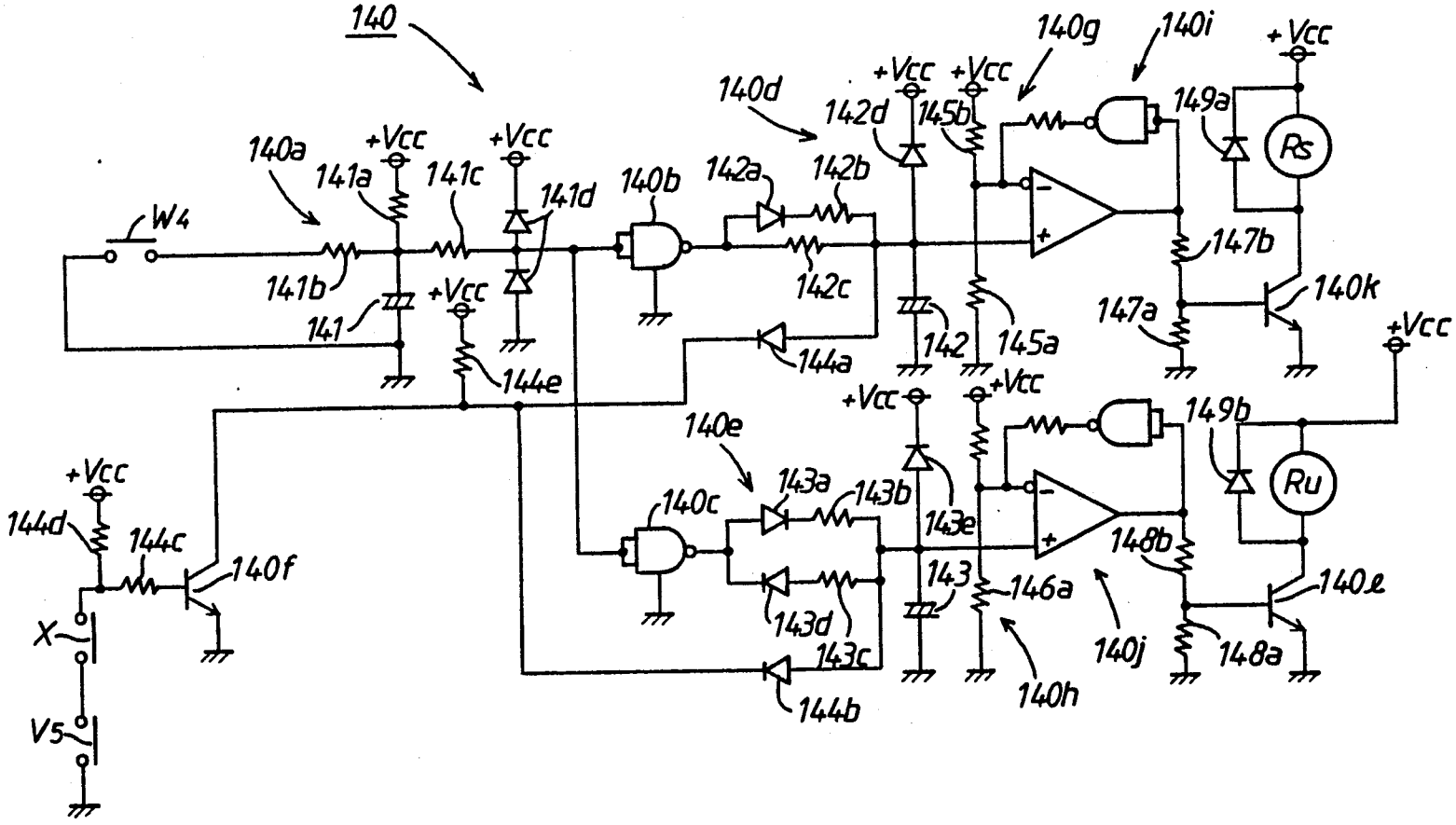
FIG. 4 is a detailed circuit diagram of an electronic driving circuit in FIG. 3.

A relay coil Rx constitutes a relay together with a normally open type relay switch X, and is energized to open the relay switch X when applied with an AC voltage from the common leads L1 and L2. Both relay coils Rs and Ru are connected via an electronic driving circuit 140 and a transformer 130 to both common leads L1 and L2, as shown in FIGS. 3 and 4. The relay coil Rs constitutes a relay together with the relay switch S1 and a normally open type relay switch S2, and closes the relay switches S1 and S2 by its selective energization. The relay switch S2 has one end connected to the common lead L1 and the other end connected to the common lead L2 via the motor Mg of the ice making machine assembly B and an overload relay La. The relay switch S2, when closed, applies the AC voltage from the common leads L1 and L2 to the motor Mg to drive it. The overload relay La functions to cut the motor Mg from the common lead L2 when the motor Mg is overloaded.

The relay coil Ru constitutes a relay together with the relay switch U1 and a normally open type relay switch U2, and opens the relay switch U1 and closes the relay switch U2 by its selective energization. The relay switch U2 has one end connected to the common lead L1 and the other end connected to the common lead L2 via the compressor motor Mc and an overload relay Lb connected in series thereto, and the fan motor Mf connected in parallel to them. The relay switch U2, when closed, applies an AC voltage to the compressor motor Mc and the fan motor Mf to drive them. The overload relay Lb functions to cut the compressor motor Mc from the common lead L2 when the motor Mc is overloaded.

The transformer 130 transforms an AC voltage from the common leads L1 and L2 and applies the resultant voltage as a low voltage to the electronic driving circuit 140. The electronic driving circuit 140 has a rectifier (not shown), which rectifies the low voltage from the transformer 130 to a DC voltage +Vcc. The electronic driving circuit 140 also has a charging circuit 140*a*, as shown in FIG. 4, which is charged by a capacitor 141 in accordance with the DC voltage +Vcc coming via a resistor 141*a* from the rectifier. The capacitor 141 is grounded at a common end to the resistor 141*a* via a resistor 141*b* and the relay switch W4. When the relay switch W4 is closed, this capacitor 141 spontaneously discharges via the resistor 141*b* and relay switch W4. Both inverters 140*b* and 140*c* generate low-level signals in response to a charge voltage coming via a resistor 141*c* from the capacitor 141 of the charging circuit 140*a*, and generate high-level signals in response to a drop of the charge voltage originating from the charging of the capacitor 141.

A delay circuit 140*d* has a capacitor 142, which is charged by the inverter 140*b* via a diode 142*a* and a resistor 142*b* in response to the generation of the high-level signal from the inverter 140*b*, producing a first charge voltage. The capacitor 142 slowly discharges through a resistor 142*c* (having a large resistance) and the inverter 140*b* in response to the generation of the low-level signal from the inverter 140*b*, thus lowering the first charge voltage. The delay time constant of the delay circuit 140*d* is selected to a charge time constant determined by the forward internal resistance of the diode 142*a*, the resistance of the resistor 142*b* and the capacitance of the capacitor 142, i.e., 0.4 sec. Accordingly, the generation of the first charge voltage from the capacitor 142 is delayed by 0.4 sec after the generation of the high-level signal from the inverter 140*b*. In FIG. 4, the reference characters 141*d* and 142*d* denote reverse-flow preventing diodes.

A delay circuit 140*e* has a capacitor 143, which is charged by the inverter 140*c* via a diode 143*a* and a resistor 143*b* in response to the generation of the high-level signal from the inverter 140*c*, producing a second charge voltage. The capacitor 143 slowly discharges through a resistor 143*c* (having a large resistance), the diode 143*d* and the inverter 140*c* in response to the generation of the low-level signal from the inverter 140*c*, thus dropping the second charge voltage. The delay time constant of the delay circuit 140*e* is selected to a charge time constant determined by the forward internal resistance of the diode 143*a*, the resistance of the resistor 143*b* and the capacitance of the capacitor 143, i.e., about 60 sec. Accordingly, the generation of the second charge voltage from the capacitor 143 is delayed by 60 sec after the generation of the high-level signal from the inverter 140*c*. In FIG. 4, the reference character 143*e* denotes a reverse-flow preventing diode.

A transistor 140*f* has its collector connected to a common end of the capacitor 142 and diode 142*d* via a diode 144*a*, and connected to a common end of the capacitor 143 and diode 143*e* via a diode 144*b*. This transistor 140*f* has its base grounded via a resistor 144*c* and both relay switches V5 and X, and connected to the aforementioned rectifier via the resistor 144*c* and a resistor 144*d*. Therefore, the transistor 140*f* becomes non-conductive when both relay switches V5 and X are closed. The transistor 140*f* becomes conductive when one of the relay switches V5 and X opens and instantaneously discharges both capacitors 142 and 143 via the diodes 144*a* and 144*b*. In FIG. 4, the reference character 144*e* denotes a pull-up resistor.

A reference voltage generator 140*g* frequency-divides the DC voltage +Vcc from the rectifier circuit by series-connected resistors 145*a* and 145*b* and outputs this frequency-divided voltage as a first reference voltage. A reference voltage generator 140*h* frequency-divides the DC voltage +Vcc from the rectifier circuit by series-connected resistors 146*a* and 146*b* and outputs this frequency-divided voltage as a second reference voltage. The first and second reference voltages are determined as values corresponding to the delay time constants of the delay circuits 140*d* and 140*e* respectively.

A comparator 140*i* generates a high-level comparison signal when the first charge voltage from the capacitor 142 of the delay circuit 140*d* is higher than the first reference voltage from the reference voltage generator 140*g*. The comparison signal from the comparator 140*i* disappears when the first charge voltage from the capacitor 142 is lower than the first reference voltage from the reference voltage generator 140*g*. A comparator 140*j* generates a high-level comparison signal when the second charge voltage from the capacitor 143 of the delay circuit 140*e* is higher than the second reference voltage from the reference voltage generator 140h. The comparison signal from the comparator 140j disappears when the second charge voltage from the capacitor 143 is lower than the second reference voltage from the reference voltage generator 140h.

A transistor 140k is biased by resistors 147a and 147b in response to the comparison signal from the comparator 140i to become conductive, energizing the relay coil Rs. The transistor 140k is rendered non-conductive in response to the disappearance of the comparison signal from the comparator 140i, deexciting the relay coil Rs. A transistor 140l is biased by resistors 148a and 148b in response to the comparison signal from the comparator 140j to become conductive, energizing the relay coil Ru. The transistor 140l is rendered non-conductive in response to the disappearance of the comparison signal from the comparator 140j, deexciting the relay coil Ru. In FIG. 4, the reference characters 149a and 149b denote diodes for absorbing a surge voltage.

In operation, when the AC voltage from the commercially available power supply Ps is applied via the circuit breaker ELB between the common leads L1 and L2 with no ice present in the aforementioned storage bin, the relay coil Rq is energized by application of the AC voltage via the stored ice detector SI to close the individual relay switches Q1, Q2 and Q3, and at the same time the relay coil Rx is energized by the AC voltage applied via the overload relay La from the common leads L1 and L2, thereby closing the relay switch X.

When the operation switch SW is temporarily closed in the above conditions, the relay coil Rv is energized by application of the AC voltage via the timer switches K and M to close the individual relay switches V1, V2, V4 and V5 and open the relay switch V3 at the same time, and is self-retained by the closing of the relay switch V2. Then, in accordance with the closing of the relay switch V1, the timer section Tk is applied with the AC voltage via the individual relay switches Q1, S1 and U1, and functions to start measuring the predetermined time Dk. Further, the closing of the relay switch V4 applies the AC voltage to the water valve WV via the stored ice detector SI and individual relay switches W3 and Q3 to open the water valve WV. As a result, the water source 60a starts supplying water in the water tank 60 via the water supply pipe 61. The relay switch X, when closed, renders the transistor 140f of the electronic driving circuit 140 non-conductive.

As the water in the water tank 60 increases, the float 76a of the float switch mechanism 70 rises to the lower limit level Ll, closing the lower limit float switch Fl. When the water in the water tank 60 further increases to raise the float 77a to the upper limit level Lu, the upper limit float switch Fu is closed. Consequently, the relay coil Rw is energized by the AC voltage applied via the stored ice detector SI, thereby closing the relay switches W1, W2 and W4 and opening the relay switch W3 at the same time. The closing of the relay switch W2 causes the relay coil Rw to be self-retained when the lower limit float switch Fl is closed.

Then, the timer section Tm operates in response to the closing of the relay switch W1 to start measuring the predetermined time Dm. The water valve WV is closed in response to the opening of the relay switch W3, cutting off water supply to the water tank 60 from the water source 60a. This completes the supply of a predetermined quantity of water to the water tank 60, filling the evaporator housing 20 with water. When the relay switch W4 is closed as described above, the charge circuit 140a of the electronic driving circuit 140 spontaneously drops the charge voltage of the capacitor 141 to generate the high-level signals from both inverters 140b and 140c. Consequently, the delay circuit 140d responds to the high-level signal from the inverter 140b with its delay time constant to charge the capacitor 142, while the delay circuit 140e responds to the high-level signal from the inverter 140c with its delay time constant to charge the capacitor 143. The charge voltage of the capacitor 142 therefore becomes higher than the reference voltage from the reference voltage generator 140g, and the comparator 140i generates a comparison signal. In response to this signal, the transistor 140k becomes conductive to energize the relay coil Rs, opening the relay switch S1 and closing the relay switch S2 at the same time. Accordingly, the motor Mg of the ice making machine assembly B is driven by the AC voltage applied via the relay switch S2 and overload relay La, causing the speed reducer 10 to rotate the auger 40 in a deceleration action.

Thereafter, when the charge voltage of the capacitor 143 rises higher than the reference voltage from the reference voltage generator 140h, the comparator 140j generates a comparison signal. In response to this signal, the transistor 140l becomes conductive to energize the relay coil Ru, opening the relay switch U1 and closing the relay switch U2 at the same time. As a result, the timer section Tk stops functioning due to the opening of the relay switch U1 with the relay switch S1 open, without opening the timer switch K. When the relay switch U2 is closed as mentioned above, the compressor motor Mc runs upon reception of the AC voltage via the overload relay Lb, so that the compressor 90 is driven by the compressor motor Mc to start a compressing action and the cooling fan 100a is driven by the fan motor Mf to start a cooling action. In the refrigeration cycle R, therefore, a refrigerant starts circulating, passing the compressor 90, condenser 100, receiver 110, expansion valve 120 and evaporator 30 under the cooling action of the cooling fan 100a. The cooling of water in the evaporator housing 20 by the evaporator 30, or ice making operation by the ice making machine starts.

In the process of such ice making operation, when the water in the evaporator housing 20 becomes flakes of ice, the ice crystals are scraped off by the helical blade 42 and are moved upward in accordance with the rotation of the auger 40. The ice crystals are compressed in a rod of hard ice by the extruding head 50, which is sequentially cut out by the cutter 53 and is retained in the storage bin after passing through the delivery duct 54. In the meantime, the water in the water tank 60 flows through the pipe 62 into the evaporator housing 20. Such an ice making operation continues thereafter.

When the lower limit float switch Fl is opened after the upper float switch Fu opens according to a reduction of water in the water tank 60, the relay coil Rw is deenergized to open the relay switches W1, W2 and W4 and close the relay switch W3 at the same time. The opening of the relay switch W1 causes the timer section Tm to stop functioning without opening the timer switch M. The closing of the relay switch W3 opens the water valve WV with both relay switches Q3 and Q4 closed to restart water supply to the water tank 60 from the water source 60a. Thereafter, the same ice making operation as described above continues by repeating water supply to the water tank 60. When the stored ice detector SI opens due to a later increase of the quantity of ice stored in the storage bin, the relay coil Rq is deenergized to open the relay switches Q1, Q2 and Q3, so that the timer section Tk stops its action and the water valve WV is kept open.

The opening of the relay switch W4 causes the charge circuit 140*a* of the electronic driving circuit 140 to spontaneously charge the capacitor 141 due to the deenergization of the relay coil Rw, permitting the inverters 140*b* and 140*c* to generate the low-level signals. Consequently, the delay circuit 140*d* instantaneously drops the charge voltage of the capacitor 142 and the delay circuit 140*e* instantaneously drops the charge voltage of the capacitor 143. The comparators 140*i* and 140*j* therefore vanish the respective comparison signals, rendering the transistors 140*k* and 140*l* non-conductive. Accordingly, the relay coil Ru is deenergized to close the relay switch U1 and open the relay switch U2 at the same time. Further, the relay coil Rs is deenergized to close the relay switch S1 and open the relay switch S2. Subsequently, the compressor 90 stops as the compressor motor Mc stops, the cooling fan 100*a* stops by the stopping of the fan motor Mf, and the motor Mg of the ice making machine assembly B stops. This completes the ice making operation of the ice making machine. When the stored ice detector SI is opened according to an increase in the quantity of ice stored in the storage bin, the relay coil Rq is deenergized to open the individual relay switches Q1, Q2 and Q3, causing the timer section Tk to stop functioning and keeping the water valve WV open. The above described operation is repeated thereafter every time ice in the storage bin comes short.

Assume that suspension of water supply has occurred while the ice making operation is being carried out with the float switch mechanism 70 in the proper state in the repetition of the above-described action. When the water level in the water tank 60 drops lower than the lower limit level Ll as the ice making operation continues, the lower limit float switch Fl opens with the upper float switch Fu open. Accordingly, the relay coil Rw is deenergized to open the relay switches W1, W2 and W4 and close the relay switch W3. The closing of the timer switch M causes the timer section Tm to stop functioning and the closing of the relay switches Q3 and Q4 causes the water valve WV to start supply water to the water tank 60 from the water source 60*a*, as in the above-described case. Like in the above case, in accordance with the opening of the relay switch W4, the relay coil Rs is deenergized to close the relay switch S1 and open the relay switch S2 at the same time, and the relay coil Ru is deenergized to close the relay switch U1 and open the relay switch U2 at the same time, causing the timer section Tk to start measuring the time and causing the ice making machine to stop the ice making operation.

The relay coil Rw keeps the deenergized state without closing the upper limit float switch Fu due to suspension of water supply. When the timer section Tk opens the timer switch K upon completion of the time measurement, the relay coil Rv is deenergized to open the relay switches V1, V2, V4 and V5 and close the relay switch V3 at the same time. Then, the timer section Tk stops functioning to close the timer switch K in response to the opening of the relay switch V1, the timer section Tn functions to start measuring the predetermined time Dna in response to the opening of the relay switch V1 with the relay switch Q2 closed, the water valve WV is closed by the opening of the relay switch V4, and the transistor 140*f*, when the relay switch V5 is open, is biased to be conductive by the resistors 144*d* and 144*c* based on the DC voltage of the aforementioned rectifier, spontaneously discharging the capacitors 142 and 143 through the respective diodes 144*a* and 144*b*. The comparators 140*i* and 140*j* therefore vanish the comparison signals to render the transistors 140*k* and 140*l* non-conductive, deexciting the relay coils Rs and Ru. The opening of the relay switch S2 stops the motor Mg and the opening of the relay switch U2 stops the compressor motor Mc and fan motor Mf.

When the predetermined time Dna is elapsed, the timer section Tn closes the timer switch N and starts measuring the predetermined time Dnb as the measuring of the predetermined time Dna has completed. When the predetermined time Dnb is elapsed next, the timer section Tn opens the timer switch N and starts measuring the predetermined time Dna as the measuring of the predetermined time Dnb has completed. Thereafter, the timer section Tn in action repeats the aforementioned operation.

While the timer section Tn is measuring the predetermined time Dna repetitively, the relay coil Ry is energized by an AC voltage applied every time the timer switch N is closed with the relay switch Q2 closed, thereby closing the relay switches Y1 and Y2. Therefore, the relay coil Rv is energized every time the relay switch Y1 is closed with both timer switches K and M closed, thereby closing the relay switches V1, V2, V4 and V5 and opening the relay switch V3. With the relay switches W3 and Q3 closed, the water valve WV is open in response to each closing of the relay switch V4. With the relay switches Q1, S1 and U1 closed, the timer section Tk starts measuring the predetermined time Dk in response to the closing of the relay switch V1, and, upon completion of the time measurement, opens the timer switch K to deenergize the relay coil Rv, thus closing the water valve WV. The relay coil Rv self retains the energization caused by the closing of the relay switch Y1 while the timer switch K and relay switch V2 are both closed. The state of the time measurement of the timer section Tn which has started by the closing of the relay switch Y2 is kept by the closing of the relay switch Y2 irrespective of the opening of the relay switch V3.

When suspension of water supply is cleared during such repetition of the opening/closing action of the water valve WV, water supply from the water source 60*a* to the water tank 60 is started upon opening of the water valve WV. Thereafter, when the upper limit float switch Fu is closed after closing of the lower limit float switch Fl according to an increase of water in the water tank 60, the relay coil Rw is energized to close the relay switches W1, W2 and W4 and open the relay switch W3. Like in the above-described case, the water valve WV is closed and the ice making machine starts the ice making operation.

As describe above, when suspension of water supply occurs, the water valve WV is repeatedly kept open during passing of the predetermined time Dk every time the predetermined time Dna elapses by the interaction of the timer sections Tk and Tn, the timer switches K and N, the relay coils Ry and Rv and the individual relay switches Y1, Y2, V1, V2 and V4. As suspension of water supply is cleared, therefore, water supply to the water tank 60 and the ice making operation of the ice making machine are automatically executed in order. In this case, during the time period until clearing of the suspension of water supply, the water valve WV is opened while each predetermined time is measured, i.e., for the time required to supply water to the water tank 60, thus minimizing the power consumption needed to open the water valve WV.

When opening of the upper limit float switch Fu is disabled by contact melting due to an excess current flowing in the reed switch 79 in the repetition of the above-described action, the relay coil Rw is kept energized to maintain the closing of the relay switches W1, W2 and W4 and the opening of the relay switches W3 as long as the stored ice detector SI is closed based on insufficient ice in the storage bin. As should be understood from the above explanation of the action, the opening of the relay switch W3 does not allow the water valve WV to be open, disabling water supply from the water source 60*a* into the water tank 60. Also, as should be understood from the above explanation of the action, the closing of the relay switch W4 holds the relay coils Rs and Ru energized to keep activating the motor Mg, compressor motor Mc and fan motor Mf.

Although water in the water tank 60 and evaporator housing 20 comes short, therefore, the evaporator 30 keeps cooling the evaporator housing 20 under the action of the compressor 90, and the auger 40 is kept functional by the motor Mg. Since the timer section Tm opens the timer switch M when the predetermined time Dm elapses after the closing of the relay switch W1, however, the relay coil Rv is deenergized, opening the relay switch V5. The transistor 140*f* is therefore biased to be conductive by the resistors 144*d* and 144*c* based on the DC voltage of the rectifier, spontaneously discharging the capacitors 142 and 143 via the respective diodes 144*a* and 144*b*. The comparators 140*i* and 140*j* therefore vanish the comparison signals to render the transistors 140*k* and 140*l* non-conductive, deexciting the relay coils Rs and Ru. The opening of the relay switch S2 stops the motor Mg and the opening of the relay switch U2 stops the compressor motor Mc and fan motor Mf.

As described above, even with the opening of the upper limit float switch Fu disabled, the relay coils Rs and Ru are deenergized to immediately stop the ice making operation of the ice-making machine by the opening of the timer switch M upon completion of time measurement in the timer section Tm after the relay switch W1 has been closed. It is therefore possible to hinder over cooling of the evaporator housing 20 due to water shortage, thereby preventing over ice forming in the evaporator housing 20. The compressor 90, motor Mg, speed reducer 10 and auger 40 can therefore keep their inherent service lives without being overloaded due to over cooling or over ice forming. The above can be true of the case where opening of the lower limit float switch Fl is disabled by contact melting due to an excess current flowing in the reed switch 78. In the case where the refrigerant of the refrigeration circuit R leaks outside even when the upper limit float switch Fu and lower limit float switch Fl are normal, the ice making operation stops upon completion of time measurement by the timer section Tm in the same manner as described above, countermeasure to the refrigerant leakage can quickly be taken.

In the case where closing of the upper limit float switch Fu is disabled due to dust or the like entering together with water in the water tank 60 and present between the stopper 75 and float 77 of the float switch mechanism 70, the upper limit float switch Fu cannot be closed even when the level of water in the water tank 60 rises to the upper limit level Lu, as described above. Accordingly, the relay coil Rw, when deenergized, keeps the relay switches W1, W2 and W4 open and the relay switch W3 closed. As described above, therefore, the opening of the water valve WV with the relay switches W3, Q3 and V4 closed keeps water supply from the water source 60*a* into the water tank 60.

When the timer switch K is opened in response to the completion of time measurement of the timer section Tk after the relay switch V1 is closed, however, the relay coil Rv is deenergized to open the relay switches V1, V2, V4 and V5 and close the relay switch V3. The opening of the relay switch V4 immediately closes the water valve WV, inhibiting water supply from the water source 60*a* to the water tank 60. As a result, water supply to the water tank 60 will not be done unnecessarily even when the closing of the upper limit float switch Fu is disabled, thus preventing wasting of water and protecting the vicinity of the location of the ice making machine from being flooded with water due to water discharge from the water tank 60.

When closing of the lower limit float switch Fl is disabled due to the aforementioned dust or the like, this float switch Fl is always open irrespective of a variation in the quantity of water in the water tank 60. When the closing of the upper limit float switch Fu energizes the relay coil Rw to close the relay switches W1, W2 and W4 and open the relay switch W3, as described above, the water valve WV is closed by the opening of the relay switch W3, stopping water supply from the water source 60*a* to the water tank 60, and the electronic driving circuit 140 starts the action of the ice making machine assembly B and the ice making operation by the closing of the relay switch W4.

In this case, although the upper limit float switch Fu is open in accordance with a decrease of water in the water tank 60, the lower limit float switch Fl is open so that the relay coil Rw is deenergized immediately after the opening of the float switch Fu, thus closing the relay switch W3. Although there is a sufficient quantity of water in the water tank 60, therefore, water is supplied from the water source 60*a* into the water tank 60 by the opening of the water valve WV. This means that repetitive opening/closing of the upper limit float switch Fu repeats the opening/closing of the water valve WV.

As described above, however, in accordance with the completion of time measurement by the timer section Tk after the relay switch V1 is closed, the relay coil Rv is deenergized by the opening of the timer switch K, thus opening the relay switches V4 and V5. The opening of the relay switch V4 closes the water valve WV and the opening of the relay switch V5 causes the electronic driving circuit 140 to deenergize the relay coils Ru and Rs, stopping the ice making operation and the action of the auger 40 as in the above-described case. In this case, the opening of the relay switch V4 minimizes the frequency of opening/closing of the water valve WV to ensure its service life.

When power failure occurs while the ice making machine is executing the ice making operation with the float switch mechanism in the proper condition, for example, the ice making machine stops the ice making operation as the individual electric components stop functioning. In this case, after recovery of power failure causes the relay coil Rq to be energized to close the relay switches Q1 and Q2, the timer section Tn starts measuring the time by the closing of the relay switch Q2, so that the ice making operation of the ice making machine is automatically performed in substantially the same manner as in the case of suspension of water supply.

Figure 5:
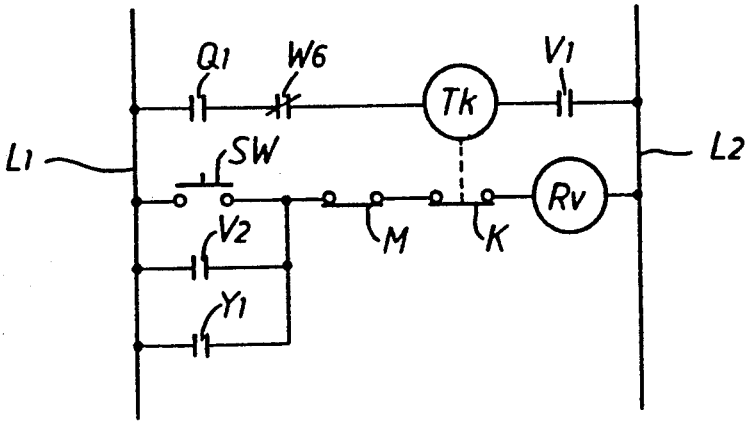
FIG. 5 is a control circuit diagram of essential portions illustrating a modification of this embodiment.

When a normally closed type relay switch W6 is connected in series to the relay switch Q1 as shown in FIG. 5, in place of the parallel circuit of the relay switches S1 and U1 in the above embodiment, the time measuring action of the timer section Tk is allowed when the relay switch W6 is closed based on the deenergization of the relay coil Rw. At the time closing of the upper limit float switch Fu is disabled, therefore, the timer section Tk opens the timer switch K without opening the relay switch W6 when completing measuring the time. Therefore, the opening of the relay switches V1, V2, V4 and V5 originating from the deenergization of the relay coil Rv inhibits the water supply of the water valve WV and the ice making operation in the same manner as described above, thus accomplishing the same advantage associated with the disabled closing of the upper limit float switch Fu as obtained in the above embodiment.

Figure 6:
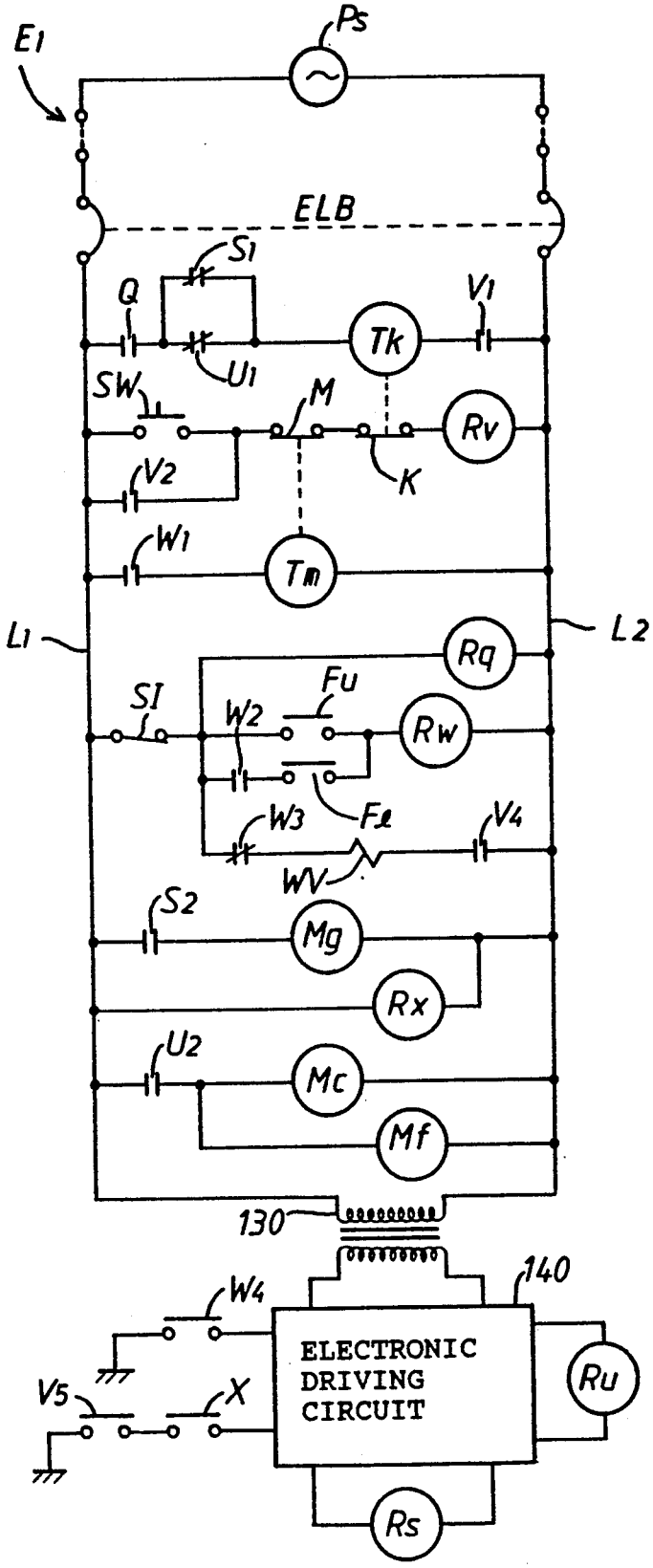
FIG. 6 is a control circuit diagram of essential portions illustrating another modification of this embodiment.

FIG. 6 illustrates a modification of the aforementioned control circuit E. In this modification, the timer section Tn, its control circuit and the relay switches Y1 and Y2, which constitute a relay together with the relay coil Ry, shown in FIG. 3, are omitted, so that when the opening or closing of the upper limit float switch Fu or lower limit float switch Fl is disabled, the motor Mg, compressor Mc and fan motor Mf stop functioning upon elapse of the predetermined time Dm under the control of the timer section Tm. As the other structure and operation are the same as those of the aforementioned control circuit E, their description will not be given.

Figure 7:
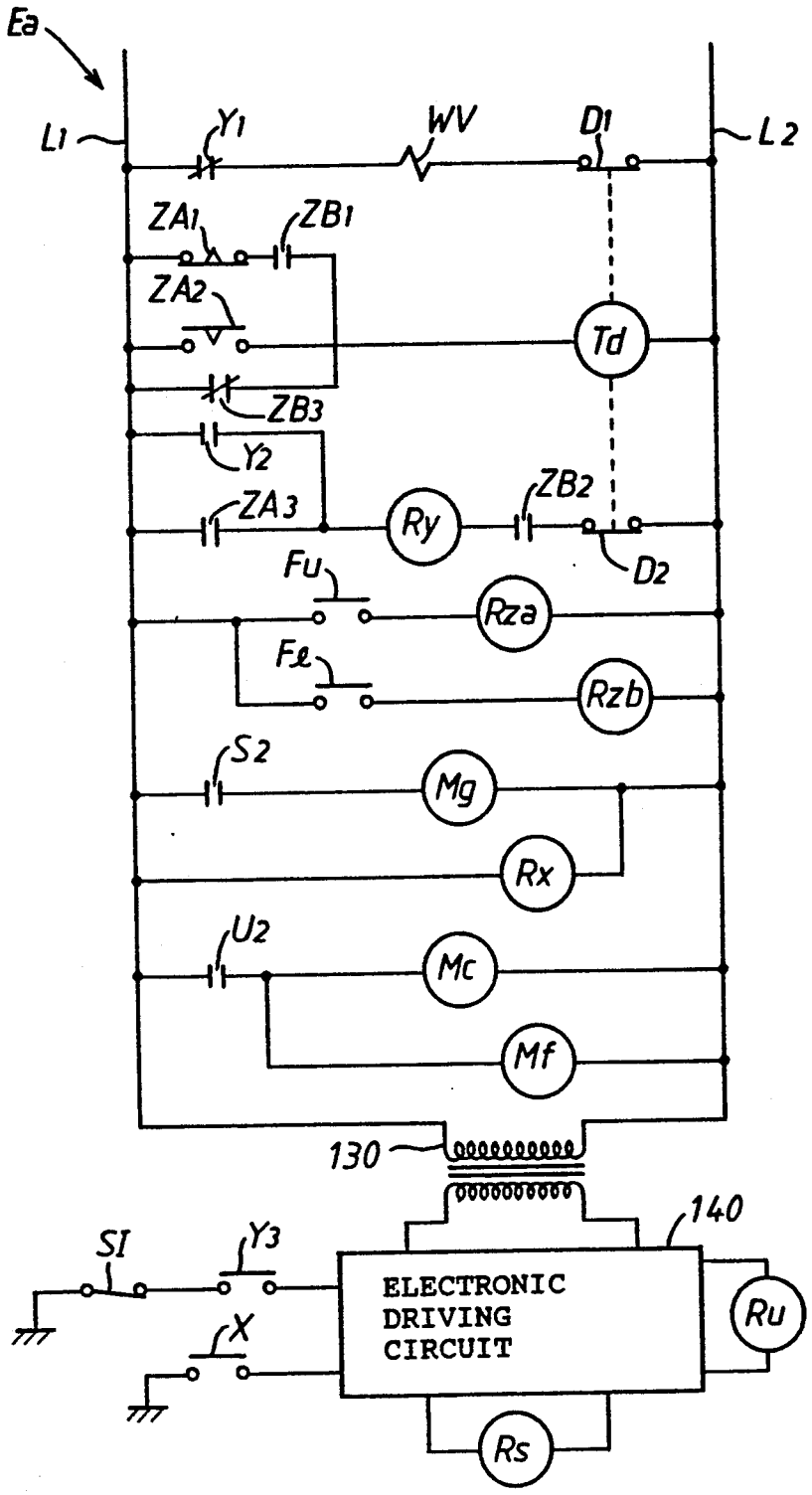
FIG. 7 is an electric control circuit diagram illustrating another embodiment of the present invention.

FIG. 7 illustrates another embodiment of the control circuit E. The control circuit Ea in this embodiment has a timer section Td, which constitutes a timer together with normally closed type timer switches D1 and D2. This timer section Td has one end connected to the common lead L2 and the other end connected to the common lead L1 through a normally closed type time-limit switch ZA1 and a normally open type relay switch ZB1 connected together in series and a parallel circuit of a normally open type time-limit switch ZA2 and a normally closed type relay switch ZB3. Accordingly, the timer section Td functions to measure a predetermined time Dd when applied with an AC voltage with either the time-limit switch ZA2 or the relay switch ZB3 closed, or the time-limit switch ZA1 and relay switch ZB1 both closed. Then, the timer section Td opens both timer switches D1 and D2 upon completion of the time measurement and cuts the timer switches D1 and D2 from the AC voltage from the common leads L1 and L2 to close the timer switches D1 and D2. The timer switch D1 has one end connected to the common lead L2 and the other end connected to the common lead L1 via the water valve WV and the normally closed type relay switch Y1. The water valve WV is therefore opened or closed by the closing or opening of the timer switch D1 with the relay switch Y1 closed. The predetermined time Dd corresponds to 1.2 to 1.5 times the time needed to form water supplied to the upper limit level Lu in the water tank 60 into ice.

Figure 8:
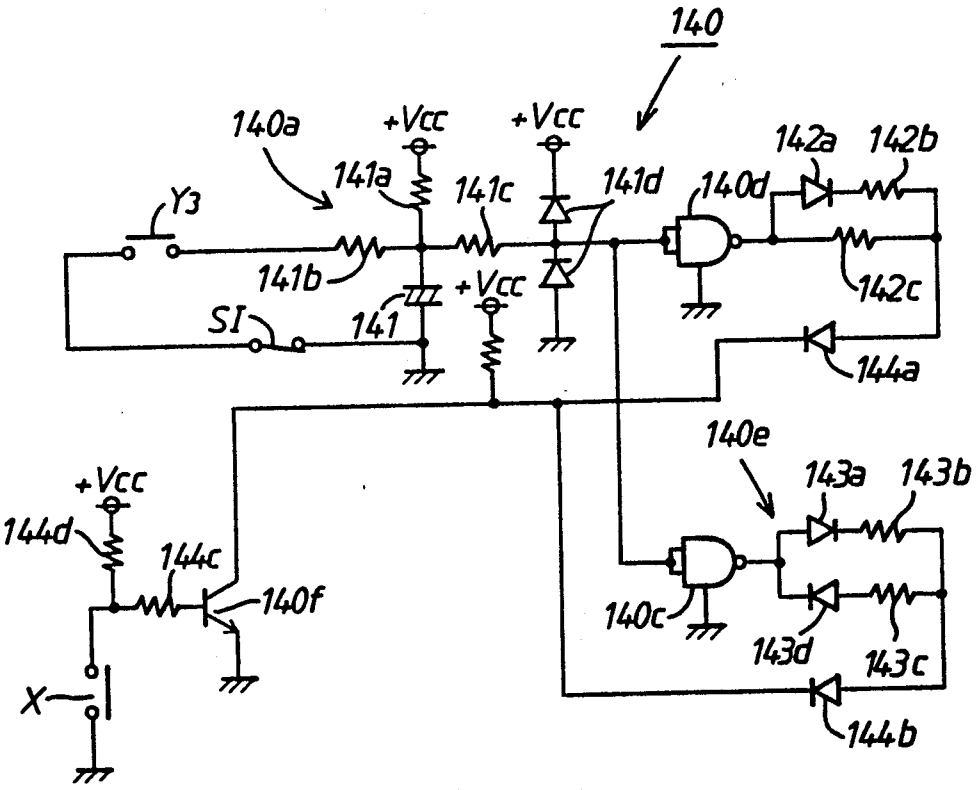
FIG. 8 is a detailed circuit diagram of essential portions of an electronic driving circuit of this embodiment.

The relay coil Ry constitutes a relay together with the relay switches Y1 and Y2, and a normally open type relay switch Y3. This relay coil Ry has one end connected to the common lead L1 via a parallel circuit of the normally open type relay switches Y2 and ZA3, and has the other end connected to the common lead L2 via the normally open type relay switch ZB2 and the timer switch D2. When applied with the AC voltage with the relay switches Y2, ZA3 and ZB2 and a timer switch Q2 closed, the relay coil Ry is energized to open the relay switch Y1 and close the relay switches Y2 and Y3. The relay switch Y3 has one end grounded via the stored ice detector SI and the other end connected to the resistor 141*b*, as shown in FIGS. 7 and 8.

A relay coil Rza constitutes a delay relay together with the time-limit switches ZA1 and ZA2 and the relay switch ZA3. This relay coil Rza has one end connected to the common lead L2 and the other end connected to the common lead L1 via the upper limit float switch Fu. The relay coil Rza is therefore energized by the AC voltage applied under closing of the upper limit float switch Fu, and thus opens the time-limit switch ZA1 with a delay and close the time-limit switch ZA2 and relay switch ZA3. When the relay coil Rza is deenergized, the time-limit switch ZA1 is instantaneously closed, the time-limit switch ZA2 is opened with a delay, and the relay switch ZA3 is opened spontaneously.

A relay coil Rzb constitutes a relay together with the relay switches ZB1, ZB2 and ZB3. This relay coil Rzb has one end connected to the common lead L2 and the other end connected to the common lead L1 via the lower limit float switch Fl. The relay coil Rzb is therefore energized by the AC voltage applied when the lower limit float switch Fl is closed, and closes the relay switches ZB1 and ZB2 while opening the relay switch ZB3.

In operation of the control circuit Ea, when an AC voltage is applied between the common leads L1 and L2 from the commercially available power supply Ps, the water valve WV is opened to supply water into the water tank 60 from the water source 60*a*. At this time, the relay coil Rx is energized to close the relay switch X, thereby rendering the transistor 140*f* non-conductive.

When the lower limit float switch Fl is closed due to an increase of water in the water tank 60, the relay coil Rzb is energized to close the relay switches ZB1 and ZB2 while opening the relay switch ZB3. Then, the timer section Td functions to start measuring the predetermined time Dd in response to the closing of the relay switch ZB1 with the relay switch ZA1 closed. Further, when the upper limit float switch Fu is closed due to an increase of water in the water tank 60, the relay coil Rza is energized to open the time-limit switch ZA1 with a delay and spontaneously close the time-limit switch ZA2 and the relay switch ZA3. The timer section Td therefore keeps measuring the time when the time-limit switch ZA2 is closed with the time-limit switch ZA1 opened with a delay. The relay coil Ry is energized to open the relay switch Y1 and close the relay switches Y2 and Y3 in response to the closing of the relay switch ZA3 with the relay switch ZB2 and time switch D2 both closed, and is self-retained by the closing of the relay switch Y2.

When the relay switch Y1 is opened as described above, the water valve WV is closed to stop supplying water to the water tank 60 from the water source 60*a*. Further, the electronic driving circuit 140 drives the auger 40 and compressor 90 by means of energization of the relay coils Rs and Ru when the relay switch Y3 is closed with the stored ice detector SI closed. After water supply to the water tank 60 is completed, therefore, the ice making machine starts its ice making operation.

When the upper limit float switch Fu is opened as the ice making operation progresses, the relay coil Rza is deenergized to spontaneously close the time-limit switch ZA1 and open the time-limit switch ZA2 with a delay as well as open the relay switch ZA3. At this time, the timer section Td continues the time measurement based on the delayed opening of the time-limit switch ZA2 and the spontaneous closing of the time-limit switch ZA1. When the lower limit float switch Fl is opened thereafter, the relay coil Rzb is deenergized to open both the relay switches ZB1 and ZB2. The opening of the relay switch ZB1 causes the timer section Td to stop functioning without opening both timer switches D1 and D2. The opening of the relay switch ZB2 deenergizes the relay coil Ry, closing the relay switch Y1 and opening the relay switches Y2 and Y3.

The closing of the relay switch Y1 opens the water valve WV to supply water to the water tank 60 from the water source 60*a*, and the electronic driving circuit stops the ice making operation by deenergization of the relay coils Rs and Ru in response to the opening of the relay switch Y3. The ice making operation and water supply to the water tank 60 are repeated thereafter in the same manner as described above. When the stored ice detector SI is opened later in accordance with an increase in the quantity of ice in the storage bin with the relay switch Y3 closed, the electronic driving circuit 140 completes the ice making operation by deenergization of the relay coils Rs and Ru. The above-described action will be repeated every time ice in the storage bin becomes short.

When the opening of the upper limit float switch Fu is disabled in the repetition of the above-described action, the relay coil Rza, when energized, keeps the time-limit switch ZA1 open and the time-limit switch ZA2 and the relay switch ZA3 closed. As the relay switch Y1 is opened, therefore, the water valve WV cannot be opened, disabling water supply to the water tank 60. As long as the stored ice detector SI is closed, the relay coils Rs and Ru are kept energized by the closing of the relay switch Y3, permitting the ice making operation to continue. This means that the ice making machine continues the ice making operation even when water in the water tank 60 comes short.

Since the timer section Td opens both timer switches D1 and D2 upon elapse of the predetermined time Dd after the time-limit switch ZB1 is closed, however, the relay coil Ry is deenergized by the opening of the timer switch D2 to close the relay switch Y1 and open the relay switches Y2 and Y3. The electronic driving circuit 140 therefore stops the ice making operation in response to the opening of the relay switch Y3. At this time, the water valve WV is closed with the timer switch D1 opened, regardless of the closing of the relay switch Y1.

As described above, even if the opening of the upper limit float switch Fu is disabled, the relay coils Rs and Ru are deenergized to immediately stop the ice making operation of the ice making machine by the opening of the timer switch D2, which is originated from the termination of time measurement in the timer section Td after the time-limit switch ZB1 is closed. The above is also true of the case when the opening of the lower limit float switch Fl is disabled.

With the closing of the upper limit float switch Fu disabled, even when the level of water in the water tank 60 rises to the upper limit level Lu, the relay coil Rza will not be energized, keeping the time-limit switch ZA1 closed and the time-limit switch ZA2 and relay switch ZA3 opened. Accordingly, the closing of the relay switch Y1 keeps water supply from the water source 60*a* to the water tank 60 via the water valve WV.

When the timer switch D1 is opened due to the completion of the time measurement in the timer section Td after the relay switch ZB1 is closed, however, the water valve WV is closed to immediately inhibit water supply to the water tank 60 from the water source 60*a*.

With the closing of the lower limit float switch Fl disabled, even when the upper limit float switch Fu is closed according to water supply to the water tank 60, the closing of the relay switch Y1 permits water supply from the water source 60*a* to the water tank 60 to continue.

After the relay coil Rza, when energized by the closing of the upper limit float switch Fu, closes the time-limit switch ZA2, however, the timer section Td completes measuring the time with the relay switch ZB3 closed, thus opening the timer switch D1. This closes the water valve WV to inhibit water supply to the water tank 60. It is therefore possible to prevent water from being wasted and protect the vicinity of the location of the ice making machine from being flooded with water.

Figure 9:
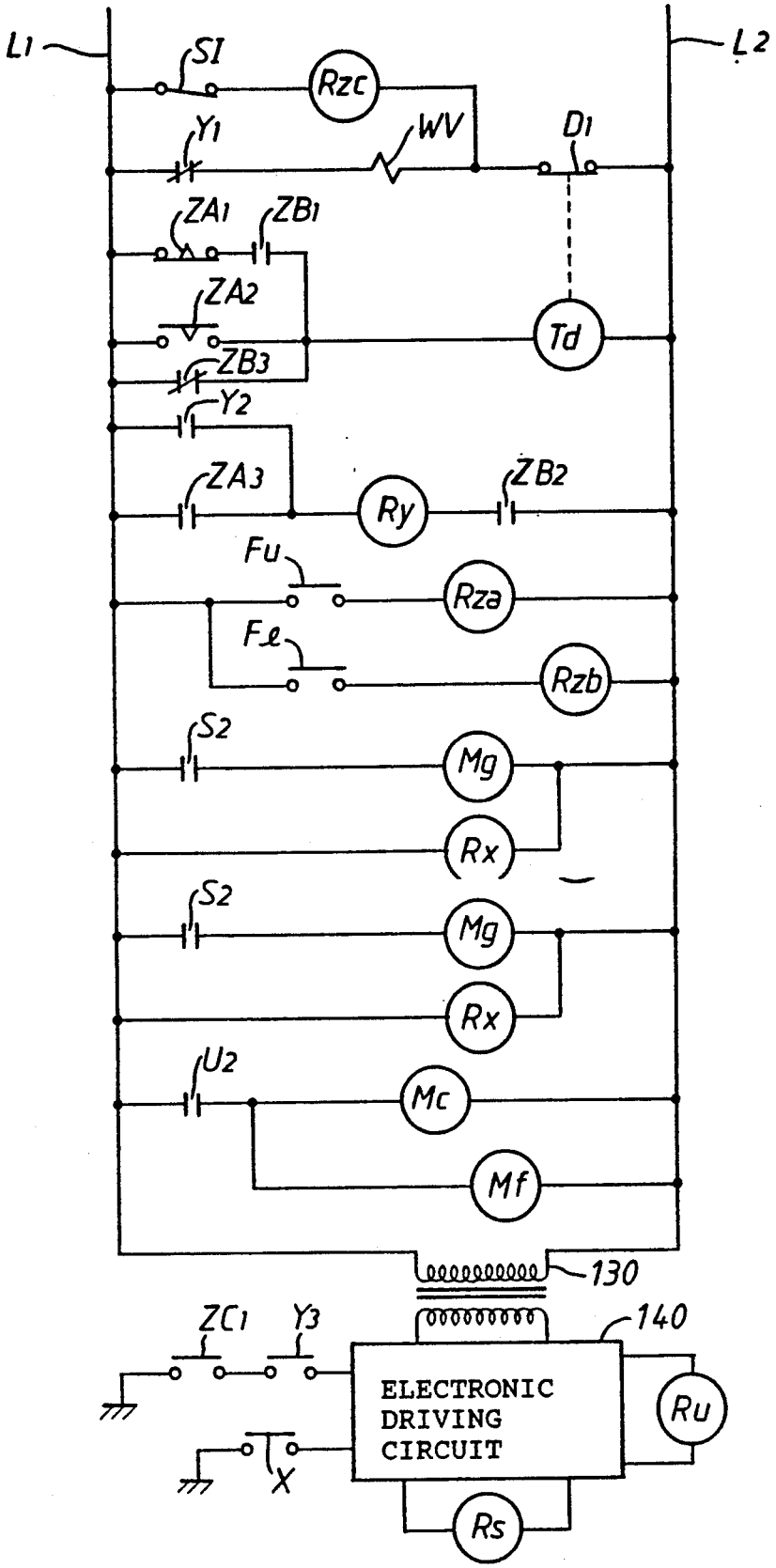
FIG. 9 is an electric control circuit diagram illustrating a modification of the second embodiment.
Figure 10:
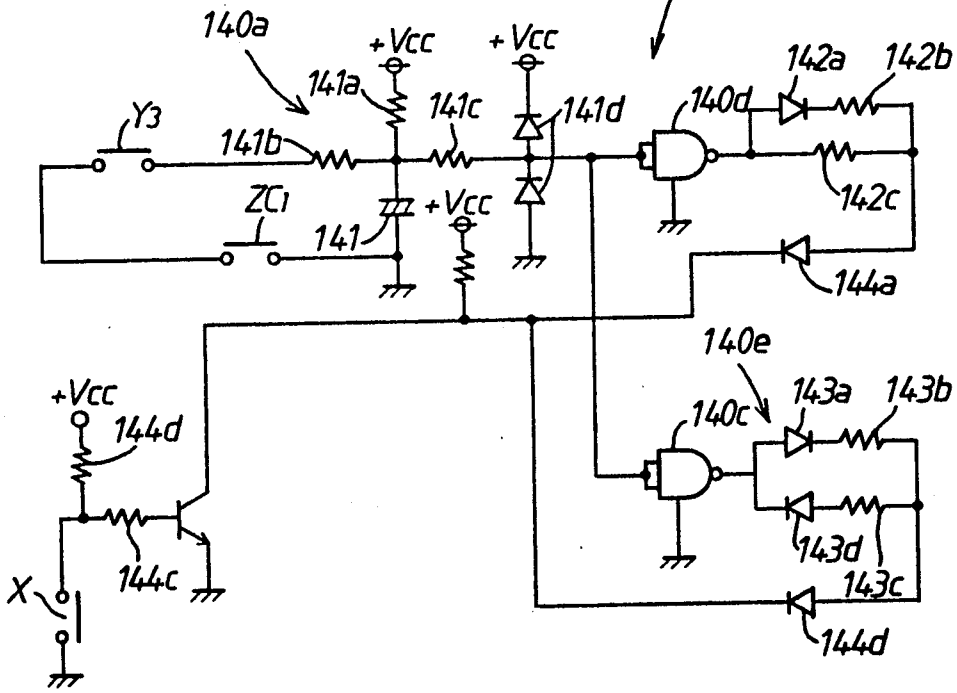
FIG. 10 is a detailed circuit diagram of essential portions of an electronic driving circuit of this modification.

FIGS. 9 and 10 illustrate a modification of the control circuit Ea. In this modification, a relay coil Rzc which constitutes a relay together with a normally open type relay switch ZC1 has one end connected via the stored ice detector SI to the common lead L1, and has the other end connected via the timer switch D1 to the common lead L2. The relay coil Rzc is therefore energized by an AC voltage applied when the stored ice detector SI and timer switch D1 are both closed, thereby closing the relay switch ZC1. The relay switch ZC1 has one end grounded and the other end connected to the relay switch Y3. The timer switch D2 is omitted.

In operation of the modification, when an AC voltage is applied between the common leads L1 and L2 from the commercially available power supply Ps, the relay coil Rzc is energized to thereby close the relay switch ZC1 with the stored ice detector SI and timer switch D1 both closed. When the relay switch Y3 is closed thereafter, the electronic driving circuit 140 permits the ice making machine to carry out the ice making operation by energization of the relay coils Rs and Ru. When the stored ice detector SI is opened upon completion of the ice making operation, the relay coil Rzc is deenergized to open the relay switch ZC1. The electronic driving circuit 140 therefore stops the ice making operation by deenergization of the relay coils Rs and Ru. With the closing of the upper limit float switch Fu or lower limit float switch Fl disabled, when the timer section Td opens the timer switch D1 upon completion of the time measurement after the time-limit switch ZA2 or relay switch ZB1 is closed, the water valve WV is closed to stop supplying water to the water tank 60. At the same time, the relay coil Rzc is deenergized to open the relay switch ZC1, causing the electronic driving circuit 140 to stop the ice making operation.

We claim:

1. An electric control apparatus for an auger type ice making machine having a water tank for supplying water connected to an evaporator housing incorporating an auger rotatable by an electric motor and having an evaporator provided on an outer wall thereof, a compressor connected to the evaporator, a water tank arranged to supply fresh water therefrom into the evaporator housing, and a solenoid water valve disposed within a water supply pipe connecting the water tank to a source of water, to thereby permit supply fresh water into the tank when the solenoid water valve is opened by energization thereof, the electric control apparatus comprising:

a first float switch for detecting the level of water in the water tank to be actuated when the water level drops below a lower limit;

a second float switch for detecting the level of water in the water tank to be actuated when the water level reaches an upper limit;

a first control means for, when the first float switch is actuated, opening the solenoid water valve by energization thereof and cutting off power supply to the electric motor and the compressor;

a second control means for, when the second float switch is actuated after the first float switch is actuated in accordance with an increase of water in the water tank, closing the solenoid water valve by deenergization thereof and then permitting power supply to the electric motor and the compressor;

a first timer means for, when the first float switch is actuated, starting measurement of a first control time set longer by a predetermined time than a time for the level of water in the water tank to reach the upper limit from the lower limit; and a third control means for closing the solenoid water valve by deenergization thereof when the measurement of the first control time terminates in a condition where the first float switch is not switched due to suspension of water supply.

2. An electric control apparatus as claimed in claim 1, further comprising:

a second timer means for sequentially and repeatedly measuring a predetermined second control time and a predetermined third control time when the solenoid water valve is closed by deenergization thereof under control of the third control means; and a fourth control means for energizing the solenoid water valve while the second control time is being measured by the second timer means and for deenergizing the solenoid water valve while the third control time is being measured by the second timer means.

3. An electric control apparatus as claimed in claim 1, further comprising:

a second time means for, when the second float switch is actuated, starting measurement of a second control time corresponding to a time for the level of water in the water tank to drop below the lower limit from the upper limit; and a fourth control means for cutting off power supply to the electric motor and compressor when the measurement of the second control time terminates in a condition where the first float switch is not actuated in accordance with a decrease of water in the water tank.

4. An electric control apparatus as claimed in claim 3, further comprising:

a fifth control means for closing the solenoid water valve by deenergization thereof when the measurement of the first control time terminates in a condition where the second float switch is not actuated in accordance with an increase of water in the water tank and for cutting off power supply to the electric motor and compressor when the measurement of the second control time terminates in a condition where the second float switch is not switched in accordance with a decrease of water in the water tank.

5. An electric control apparatus for an auger type ice making machine having a water tank for supplying water connected to an evaporator housing incorporating an auger rotatable by an electric motor and having an evaporator provided on an outer wall thereof, a compressor connected to the evaporator, a water tank arranged to supply fresh water therefrom into the evaporator housing, and a solenoid water valve disposed within a water supply pipe connecting the water tank to a source of water, to thereby permit supply fresh water into the tank when the solenoid water valve is opened by energization thereof, the electric control apparatus comprising:

a first float switch for detecting the level of water in the water tank to be actuated when the water level drops below a lower limit;

a second float switch for detecting the level of water in the water tank to be actuated when the water level reaches an upper limit;

a first control means for, when the first float switch is actuated, opening the solenoid water valve by energization thereof and cutting off power supply to the electric motor and the compressor;

a second control means for, when the second float switch is actuated after the first float switch is actuated in accordance with an increase of water in the water tank, closing the solenoid water valve by deenergization thereof and then permitting power supply to the electric motor and the compressor;

a timer means for, when the second float switch is actuated, starting measurement of a control time corresponding to a time for the level of water in the water tank to drop from the upper limit to the lower limit; and a third control means for cutting off power supply to the electric motor and compressor when the measurement of the control time terminates in a condition where the first float switch is not actuated due to malfunction thereof in accordance with a decrease of water in the water tank.

* * * * *